US011707662B1

(12) United States Patent
Schroeder et al.

(10) Patent No.: US 11,707,662 B1
(45) Date of Patent: Jul. 25, 2023

(54) OUTDOOR WORKOUT STATION

(71) Applicant: Samson Equipment, Inc., Fairacres, NM (US)

(72) Inventors: Brian Lee Schroeder, Columbia, MO (US); David Lee Schroeder, Las Cruces, NM (US)

(73) Assignee: Samson Equipment, Inc., Fairacres, NM (US)

( * ) Notice: Subject to any disclaimer, the term of this patent is extended or adjusted under 35 U.S.C. 154(b) by 65 days.

(21) Appl. No.: 17/319,397

(22) Filed: May 13, 2021

Related U.S. Application Data

(60) Provisional application No. 63/029,905, filed on May 26, 2020, provisional application No. 63/024,404, filed on May 13, 2020.

(51) Int. Cl.

| | |
|---|---|
| ***A63B 71/02*** | (2006.01) |
| ***A63B 71/00*** | (2006.01) |
| ***E04H 1/12*** | (2006.01) |
| ***E04B 5/10*** | (2006.01) |
| ***E04F 10/02*** | (2006.01) |
| ***A63B 21/06*** | (2006.01) |

(52) U.S. Cl.
CPC ..... *A63B 71/02* (2013.01); *A63B 21/06* (2013.01); *A63B 71/0036* (2013.01); *E04B 5/10* (2013.01); *E04F 10/02* (2013.01); *E04H 1/1205* (2013.01)

(58) Field of Classification Search
None
See application file for complete search history.

(56) References Cited

U.S. PATENT DOCUMENTS

| | | | | |
|---|---|---|---|---|
| 2,664,890 | A * | 1/1954 | Wallace | A61G 10/04 128/205.26 |
| 4,157,089 | A * | 6/1979 | Loughrey | A61G 13/009 606/245 |
| 4,635,934 | A * | 1/1987 | Roethke | A63B 23/00 482/104 |
| 4,781,374 | A * | 11/1988 | Lederman | A63B 21/154 482/99 |
| 9,308,410 | B2 * | 4/2016 | Beaver | A63B 26/00 |
| 10,398,937 | B2 * | 9/2019 | Beaver | A63B 71/02 |
| 10,967,224 | B2 * | 4/2021 | Beaver | B65D 88/121 |
| 2002/0106620 | A1 * | 8/2002 | Barnum | G07C 13/00 434/306 |
| 2007/0099773 | A1 * | 5/2007 | Hummer | A63B 21/078 482/104 |

(Continued)

FOREIGN PATENT DOCUMENTS

| | | | | |
|---|---|---|---|---|
| DE | 202006001435 U1 * | 6/2006 | | A63B 21/0615 |
| WO | WO-2016176733 A1 * | 11/2016 | | A63B 17/02 |
| WO | WO-2019147117 A1 * | 8/2019 | | |

*Primary Examiner* — Joshua K Ihezie
(74) *Attorney, Agent, or Firm* — Larry E. Henneman, Jr.; Baker & Rannells, PA

(57) ABSTRACT

A novel outdoor workout station includes a platform, an exercise structure, and a canopy assembly. The exercise structure is disposed on and fixed to the platform, and the canopy assembly is disposed over both the exercise structure and the platform. The arrangement of support beams of the platform corresponds to a footprint of the exercise structure. In a particular embodiment, the platform includes adjustable legs that facilitate the leveling of the platform. In another particular embodiment, the canopy assembly is mounted directly to the platform.

46 Claims, 12 Drawing Sheets

(56) References Cited

U.S. PATENT DOCUMENTS

| | | | | |
|---|---|---|---|---|
| 2012/0231935 | A1* | 9/2012 | Langhart | A63B 71/02 135/96 |
| 2015/0321048 | A1* | 11/2015 | Ross | A63B 22/0005 482/92 |
| 2019/0275364 | A1* | 9/2019 | Saunders | A63B 21/0004 |
| 2020/0139181 | A1* | 5/2020 | Thomas | A63B 21/078 |
| 2020/0254295 | A1* | 8/2020 | Watterson | A63B 21/00192 |
| 2021/0228935 | A1* | 7/2021 | Duplechain | A63B 21/151 |
| 2022/0305325 | A1* | 9/2022 | Souffrain | A63B 1/00 |

* cited by examiner

OUTDOOR WORKOUT STATION

RELATED APPLICATIONS

This application claims the benefit of priority of U.S. Provisional Patent Application No. 63/024,404, filed on May 13, 2020 by the same inventors, and also claims the benefit of priority of U.S. Provisional Patent Application No. 63/029,905, filed on May 26, 2020 and having at least one common inventor. Both prior applications are incorporated herein by reference in their respective entirety.

BACKGROUND OF THE INVENTION

Field of the Invention

This invention relates generally to workout equipment, and more particularly to outdoor workout equipment.

Description of the Background Art

Many exercise enthusiasts prefer exercising outdoors. For example, outdoor weight lifting facilities are popular in regions where warm weather prevails. One challenge with outdoor weight lifting facilities is that inclement weather (e.g. rain) is often unpredictable, thereby resulting in unpredictable operating times in such facilities. Another challenge is that what may be preferred weather to one individual may not necessarily be preferred by another. For example, many individuals prefer to be exposed to intense sunlight while working out while others prefer to be shielded from direct sunlight. Another challenge with outdoor weight lifting facilities is that it is difficult to stabilize and level heavy weight lifting equipment on the ground. Another challenge with outdoor weight lifting facilities is that puddles often accumulate on the ground around the equipment after it rains. Of course, most people are not willing to stand in a puddle during their exercise routine so they must wait for it to dry. Yet another problem with outdoor weight lifting facilities is that slippery ground can be dangerous, especially to athletes lifting heavy weights, where even a minor slip can result in a serious injury.

SUMMARY

The present invention overcomes the problems associated with the prior art by providing an outdoor workout station. The invention provides a safe, stable environment for heavy exercise equipment, even on unlevel ground.

An example workout station includes an exercise structure, a platform, and a canopy. The platform is configured to support the exercise structure thereon. The canopy assembly can include a frame coupled to the platform and a cover supported over the platform by the frame. In the example workout station, the platform can include a frame and a plurality of legs. The legs can be coupled to the frame of the platform, and each of the legs can include a bottom portion and an opposite top portion. Each bottom portion can be configured to rest on an underlying supporting surface. Each top portion can be adjustably coupled to the frame of the platform to facilitate the leveling of the platform by raising and lowering each leg with respect to the platform.

In an example workout station, the frame of the platform can include a first beam extending along a first direction and a second beam extending along a second direction parallel to the first direction. The example exercise structure can include a first bottom portion and a second bottom portion.

The first bottom portion is configured to support at least a portion of the weight of the exercise structure and is disposed over the first beam of the platform. The second bottom portion is configured to support at least a portion of the weight of the exercise structure and is disposed over the second beam. The first bottom portion of the exercise structure can be fixed to the first beam, and the second bottom portion of the exercise structure can be fixed to the second beam.

In a particular example workout station, the exercise structure can include a first beam extending along a third direction that is parallel to the first direction of the first beam of the frame of the platform. The first beam of the exercise structure can form the first bottom portion of the exercise structure and is disposed over the first beam of the frame of the platform. The exercise structure can also include a second beam extending along a fourth direction that is parallel to the second direction of the second beam of the frame of the platform. The second beam of the exercise structure can form the second bottom portion of the exercise structure and is disposed over the second beam of the frame of the platform. The exercise structure can additionally include a first column extending upward from the first beam of the exercise structure and a second column extending upward from the second beam of the exercise structure.

In an example workout station, the frame of the platform can include a third beam and a fourth beam. The third beam can extend along a third direction that is perpendicular to the first direction (i.e., of the first beam) and includes a first end and an opposite second end. The fourth beam can extend along a fourth direction that is parallel to the third direction (i.e., of the third beam) and includes a first end and an opposite second end. The first beam of the frame of the platform includes a first end and an opposite second end, and the second beam of the frame of the platform includes a first end and an opposite second end. The first end of the first beam of the frame of the platform can be coupled to the first end of the third beam of the frame of the platform, and the second end of the first beam of the frame of the platform can be coupled to the first end of the fourth beam of the frame of the platform. Additionally, the first end of the second beam of the frame of the platform can be coupled to the second end of the third beam of the frame of the platform, and the second end of the second beam of the frame of the platform can be coupled to the second end of the fourth beam of the frame of the platform.

In an example workout station, the plurality of legs can include a first leg, a second leg, a third leg, and a fourth leg. The first leg can be disposed proximate the first end of the first beam of the frame of the platform and proximate the first end of the third beam of the frame of the platform. The second leg can be disposed proximate the second end of the first beam of the frame of the platform and proximate the first end of the fourth beam of the frame of the platform. The third leg can be disposed proximate the first end of the second beam of the frame of the platform and proximate the second end of the third beam of the frame of the platform. The fourth leg can be disposed proximate the second end of the second beam of the frame of the platform and proximate the second end of the fourth beam of the frame of the platform.

An example workout station can additionally include a first panel (e.g., flooring). The first panel can be supported by and between the first beam of the frame of the platform, the second beam of the frame of the platform, the third beam of the frame of the platform, and the fourth beam of the frame of the platform. Optionally, the example workout station can additionally include a second panel supported on the first panel.

In an example workout station, the frame of the platform can further include a fifth beam, a sixth beam, a seventh beam, an eighth beam, a ninth beam, and a tenth beam. The fifth beam includes a first end and an opposite second end and can extend along a direction that is parallel to the first direction (i.e., parallel to the first beam). The sixth beam includes a first end and an opposite second end and can extend along the third direction (i.e., of the third beam). The seventh beam includes a first end and an opposite second end and can extend along the fourth direction (i.e., of the fourth beam). The eighth beam includes a first end and an opposite second end and can extend along a direction that is parallel to the first direction. The ninth beam includes a first end and an opposite second end and can extend along the third direction. The tenth beam includes a first end and an opposite second end and can extend along the fourth direction. The first end of the fifth beam of the frame of the platform can be coupled to the second end of the sixth beam of the frame of the platform, and the second end of the fifth beam of the frame of the platform can be coupled to the second end of the seventh beam of the frame of the platform. The first end of the sixth beam can be coupled to at least one of the first end of the second beam of the frame of the platform and the second end of the third beam of the frame of the platform. The first end of the seventh beam can be coupled to at least one of the second end of the second beam of the frame of the platform and the second end of the fourth beam of the frame of the platform. The first end of the eighth beam of the frame of the platform can be coupled to the first end of the ninth beam of the frame of the platform, and the second end of the eighth beam of the frame of the platform can be coupled to the first end of the tenth beam of the frame of the platform. The second end of the ninth beam can be coupled to at least one of the first end of the first beam of the frame of the platform and the first end of the third beam of the frame of the platform. The second end of the tenth beam can be coupled to at least one of the second end of the first beam of the frame of the platform and the first end of the fourth beam of the frame of the platform. So connected, the beams of the platform form a frame with three adjacent rectangular sections that can be assembled and/or leveled sequentially, starting with the center section.

In the example workout station, the plurality of leveling legs includes a first leg, a second leg, a third leg, a fourth leg, a fifth leg, a sixth leg, a seventh leg, and an eighth leg. The first leg can be disposed proximate the first end of the first beam of the frame of the platform, and the second leg can be disposed proximate the second end of the first beam of the frame of the platform. The third leg can be disposed proximate the first end of the second beam of the frame of the platform, and the fourth leg can be disposed proximate the second end of the second beam of the frame of the platform. The fifth leg can be disposed proximate the first end of the fifth beam of the frame of the platform, and the sixth leg can be disposed proximate the second end of the fifth beam of the frame of the platform. The seventh leg can be disposed proximate the first end of the eighth beam of the frame of the platform, and the eighth leg can be disposed proximate the second end of the eighth beam of the frame of the platform.

An example workout station can additionally include a first floor panel, a second floor panel, and a third floor panel. The first floor panel can be supported by and between the first beam, the second beam, the third beam, and the fourth beam of the frame of the platform. The second floor panel can be supported by and between the second beam, the fifth beam, the sixth beam, and the seventh beam of the frame of the platform. The third floor panel can be supported by and between the first beam, the eighth beam, the ninth beam, and the tenth beam of the frame of the platform. In a particular example workstation, the second floor panel and the third floor panel have the same size and/or shape.

The example workout station can additionally include a fourth floor panel, a fifth floor panel, and a sixth floor panel. The fourth floor panel can be supported on the first floor panel, the fifth floor panel can be supported on the second floor panel, and the sixth floor panel can be supported on the third floor panel. The first floor panel and the fourth floor panel have the same shape and/or size. The second floor panel, the third floor panel, the fifth floor panel, and the sixth floor panel can all have the same shape and/or size.

In an example workout station, the frame of the platform can be supported by the plurality of legs. The exercise structure can be supported by the platform, and the frame of the canopy can also be supported by the platform.

In an example workout station, the platform can include a first support beam and a second support beam, and the exercise structure defines a footprint on the platform. The footprint can include a first portion disposed over the first support beam and a second portion disposed over the second support beam. The first portion of the footprint can have a center, and the center of the first portion of the footprint can be disposed over the first support beam. The second portion of the footprint can also have a center, and the center of the second portion of the footprint can be disposed over the second beam.

In a particular example workout station, the exercise structure can be a weight rack. The weight rack can have a first side frame, a second side frame, and one or more transverse members coupling the first side frame to the second side frame. The first support beam can extend along a first direction, and the second support beam extends along a second direction. The first side frame can have an elongated bottom member extending along the first direction and defining the first portion of the footprint, and the second side frame can have an elongated bottom member extending along the second direction and defining the second portion of the footprint.

In the example workout station, the position of the weight rack on the platform can be selectively adjustable. The first support beam can be substantially parallel to the second support beam. The first support beam can define a plurality of attachment apertures, and the second support beam defines a complementary second plurality of attachment apertures. The elongated bottom member of the first side frame can be substantially parallel to the elongated bottom member of the second side frame. The elongated bottom member of the first side frame can define a third plurality of attachment apertures, and the elongated bottom member of the second side frame can define a complementary fourth plurality of attachment apertures. The first plurality of attachment apertures can include a greater number of attachment apertures than the third plurality of attachment apertures, and the second plurality of attachment apertures can include a greater number of apertures than the fourth plurality of attachment apertures. The apertures of the third plurality of attachment apertures can arranged to align with different subsets of attachment apertures of the first plurality of attachment apertures, and the apertures of the fourth plurality of attachment apertures can be arranged to align with different subsets of attachment apertures of the second set of attachment apertures. The position of the weight rack on the platform can be adjusted by selectively aligning the third plurality of attachment apertures with a particular one of the subsets of attachment apertures of the first set of attachment apertures, and selectively aligning the fourth plurality of attachment apertures with a particular one of the subsets of attachment apertures of the second set of attachment apertures. Fasteners can be disposed through the aligned attachment apertures to secure the weight rack to the beams of the platform.

An example workout station can include a weight rack, a platform, and a canopy. The weight rack can include a tubular frame, and the tubular frame can include a plurality of bottom tubes arranged together to rest on a flat surface of the platform. The platform can be configured to support the weight rack thereon, and the platform can include a plurality of support beams arranged to correspond to the bottom tubes of the weight rack. The bottom tubes of the weight rack can be mechanically fastened to the support beams of the platform. The platform can additionally include a plurality of leveling legs. The canopy can be disposed to shade at least a portion of the platform.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing an outdoor workout station including a platform and a canopy. The platform supports exercise equipment thereon, and the canopy is disposed over the platform. In the following description, numerous specific details are set forth (e.g., fasteners, materials, etc.) in order to provide a thorough understanding of the invention. Those skilled in the art will recognize, however, that the invention may be practiced apart from these specific details. In other instances, details of well-known manufacturing practices (e.g., stock extrusion, material strengthening, etc.) and components have been omitted, so as not to unnecessarily obscure the present invention.

Figure 1:
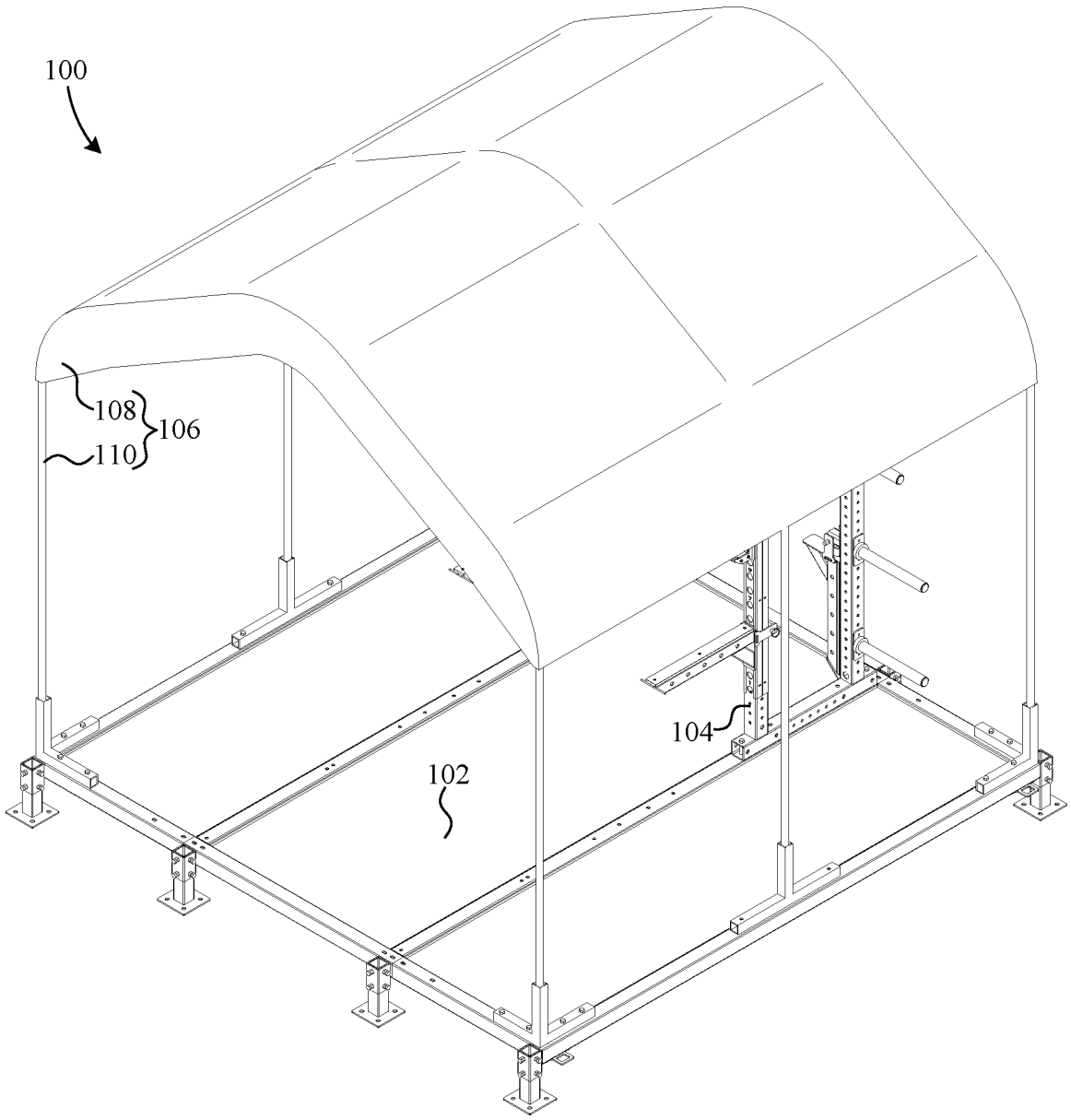
FIG. 1 is a perspective view of an outdoor weight station.

FIG. 1 shows a perspective view of an outdoor workout station 100 including a platform 102 supporting an exercise structure 104 and a canopy assembly 106. Platform 102 is disposed on a relatively uneven underlying support surface such as, for example, the ground, pavement, etc. Further, platform 102 is slightly suspended and leveled over the underlying support surface, so that exercise structure 102 is also level. Canopy assembly 106 is disposed over platform 102 to shelter platform 102 and exercise structure 104 from the outdoor elements such as rain, sunlight, etc. Canopy assembly 106 includes a cover 108 supported on a frame 110. Cover 108 is formed from material that blocks, or at least impedes, light and precipitation. Frame 110 is disposed over, and is supported by, platform 102. Alternatively, canopy assembly 106 may be disposed directly on the underlying support surface independently from platform 102.

Figure 2:
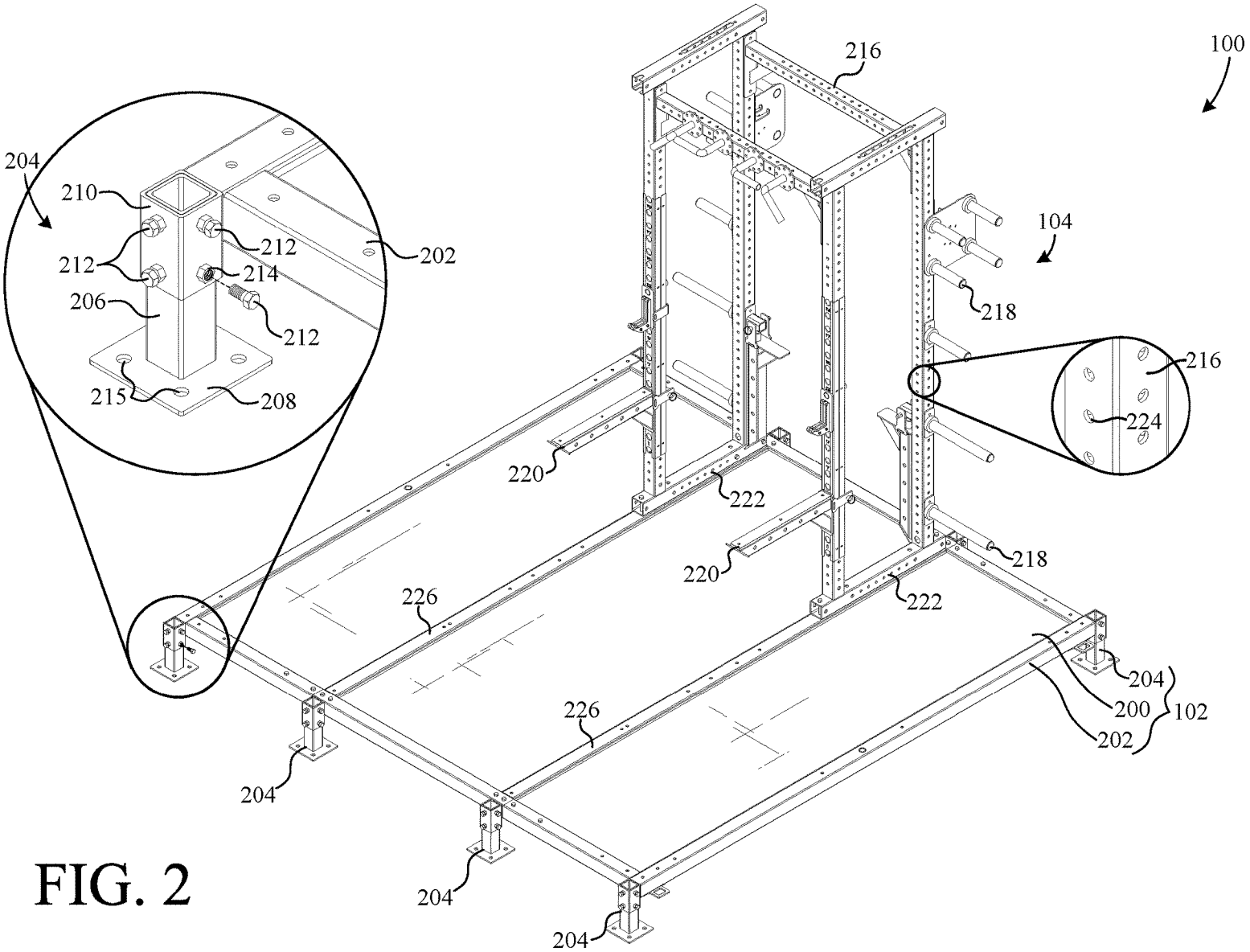
FIG. 2 is a perspective view of a platform and an exercise structure of the outdoor weight station of FIG. 1.

FIG. 2 is a perspective view of outdoor workout station 100 with canopy assembly 106 removed. Platform 102 includes a plurality of floor panels 200, a frame 202, and a plurality of adjustable legs 204. Floor panels 200 are supported on frame 202, and frame 202 is supported on legs 204.

Panels 200 provide a planar surface upon which users stand when using workout station 100 and are formed, for example, from sheets of wood (e.g., oriented strand board, plywood, and so on) or any other sufficiently strong and tough sheet material (e.g., polymer, metal, and so on). Floor panels 200 can also include layers formed of other materials (e.g., rubber, plastic, and so on) to provide desirable characteristics such as a non-slip surface. Specific details of panels 200 will be described in further detail with reference to FIG. 6.

Frame 202 provides structural support to exercise structure 104 and canopy assembly 106 (shown in FIG. 1), and includes a plurality of metal (e.g., steel, stainless steel, aluminum, etc.) beams. Specific details of frame 202 will be described in further detail with reference to FIGS. 4-7.

Each of legs 204 includes a column 206 having a bottom portion and a top portion. A foot plate 208 is attached to bottom portion of column 206, and the top portion of column 206 facilitates vertical height adjustability. More specifically, each column 206 is adjustably received within a respective column receiver 210, each of which is attached (e.g. welded) to frame 202, to facilitate the leveling of platform 102 on the ground. The distance between each foot plate 208 and respective column receiver 210 can be adjusted by moving the column 206 up or down within the respective column receiver 210. When the desired distance between foot plate 208 and frame 202 is achieved, column 206 is fixed with respect to column receiver 210 by advancing bolts 212 through respective nuts 214 to engage column 206. In this example embodiment, nuts 214 are welded to the sidewalls of receiver 210 and include threaded apertures that pass completely through the sidewalls, such that bolts 212 engage the exterior surface of column 206 when tightened. However, any suitable means of fixing the position of foot plate 208 with respect to frame 202 can be employed including, but not limited to pins/apertures, screw jack, scissor jack, and so on. Each foot plate 208 has an enlarged area that disperses the supported weight and prevents the respective leg 204 attached thereto from sinking into the underlying soil when the weight of workout station 100 is exerted thereon. Each foot plate 208 additionally includes a plurality of apertures 215 that facilitate fixing foot plate 208 to an underlying surface (e.g., soil, asphalt, and so on).

In the example embodiment, exercise structure 104 is a weight rack that is configured to support a plurality of weights and other miscellaneous equipment (e.g., weight bars, chin-up bars, a bench, etc.). Exercise structure 104 is a modular structure that includes a frame 216, various weight holders 218, a bar holder 220, and two feet 222. Frame 216 provides structural support to weight holders 218, bar holder 220, and any weights and/or weight bars disposed thereon. Frame 206 includes a plurality of apertures 224, which facilitate the selective re-positioning of weight holders 218 and bar holder 220 into any desirable configuration. Furthermore, apertures 224 allow various miscellaneous components (e.g., weight holders, bar holders, pull-up handles, etc.) to be added to and/or removed from frame 216 according to user preference. As shown, the spacing between feet 222 of frame 216 is substantially the same as the spacing between a respective set of underlying beams 226 of frame 202. This allows the weight of exercise structure 104, and any additional weight loaded thereon, to be exerted directly on beams 226 and not panels 200. In addition, because exercise structure 104 can be set up in a number of different configurations, the position of exercise structure 104 can be adjusted forward and backward and secured in any one of a number of different predefined discrete positions. However, the footprint of exercise structure 104 remains the same, regardless of the particular configuration, and therefore remains aligned with beams 226 of frame 110.

U.S. Provisional Patent Application No. 63/029,905, which is incorporated herein by reference in its entirety, discloses a modular weight station capable of multiple configurations. Because those configurations are built upon exercise structure 104, they have the same or similar footprint as exercise structure 104. Therefore, any or all of those configurations can be advantageously used in combination with platform 102 or an extended version of platform 102.

In addition, other types of exercise equipment can be used in conjunction with platform 102, as long as there is some correspondence between beams 226 and the footprint of the particular exercise equipment. For example, an elliptical running machine might have a footprint that includes four separate foot pads, and be positioned with two of the footpads being located over a portion of one of beams 226, and the other two footpads being located over the other of beams 226. In addition, corresponding apertures could be provided in the footpads to facilitate securement of the footpads to beams 226. As another example, a piece of exercise equipment might have a footprint including one or more irregular shapes. A portion of the irregular shapes sufficient to bear the load of the equipment could be positioned over beams 226. Preferably, but not necessarily, the center of each respective portion of a footprint would be positioned over one of beams. As yet another example, elongated footprints extending perpendicularly with respect to beams 226 could be arranged so that each opposite end of the footprint extends over one of beams 226.

Figure 3:
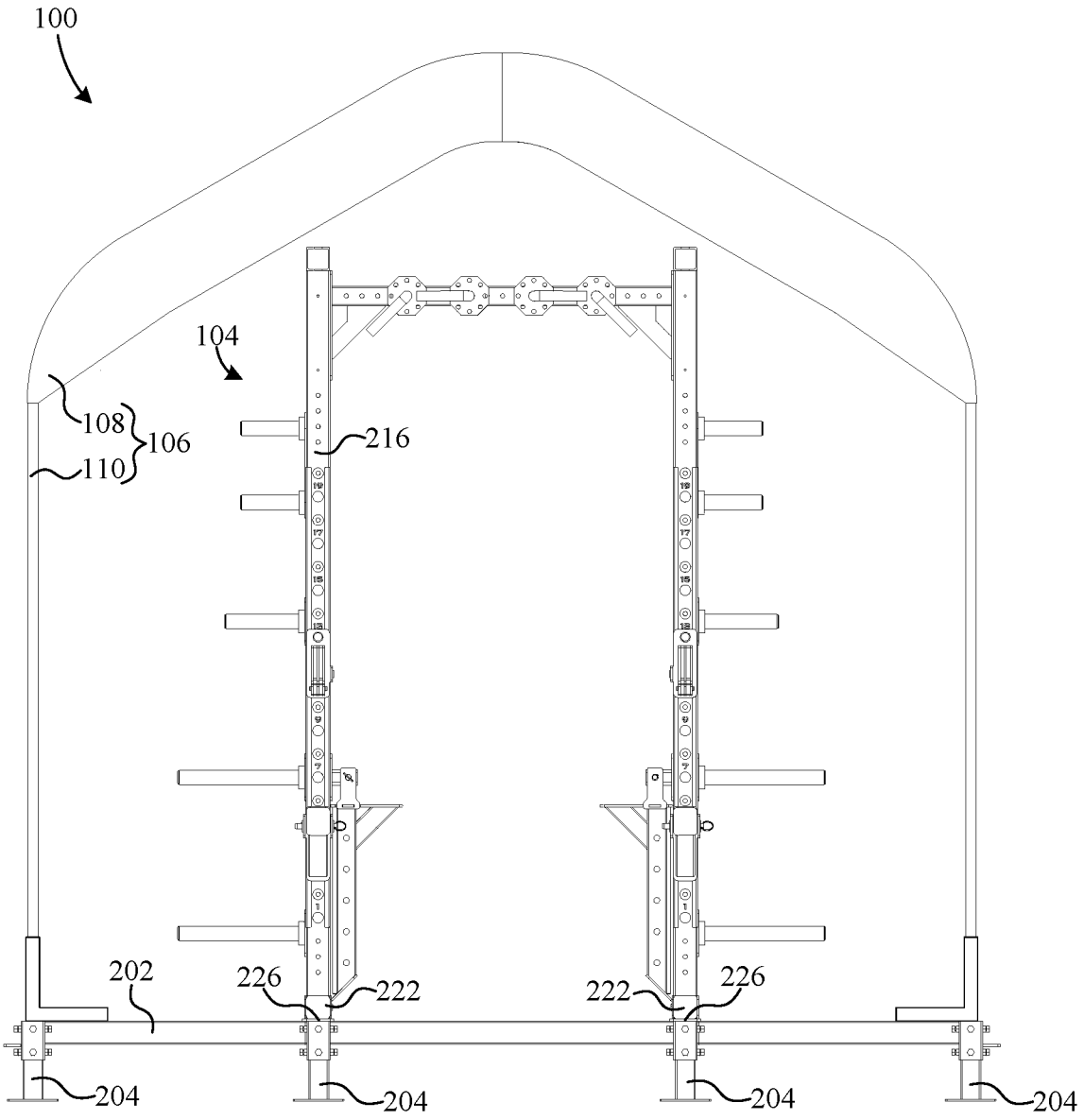
FIG. 3 is a front plan view of the outdoor weight station of FIG. 1.

FIG. 3 shows a front plan view of workout station 100. As shown, each of the middle legs 204 is directly aligned with a respective one of beams 226 and, therefore, feet 222 of exercise structure 104. This causes the majority (sometimes the entirety) of the load of exercise structure 104 and weights loaded thereon to be supported on the middle four legs 204. However, frame 202 might also transfer part of the load to the four corner legs 204 if circumstances, such as supporting terrain, require.

The components of workout station 100 will now be described in greater detail with reference to FIGS. 4-9, after which an example method of assembling workout station 100 will be summarized with reference to the same FIGS. 4-9.

Figure 4:
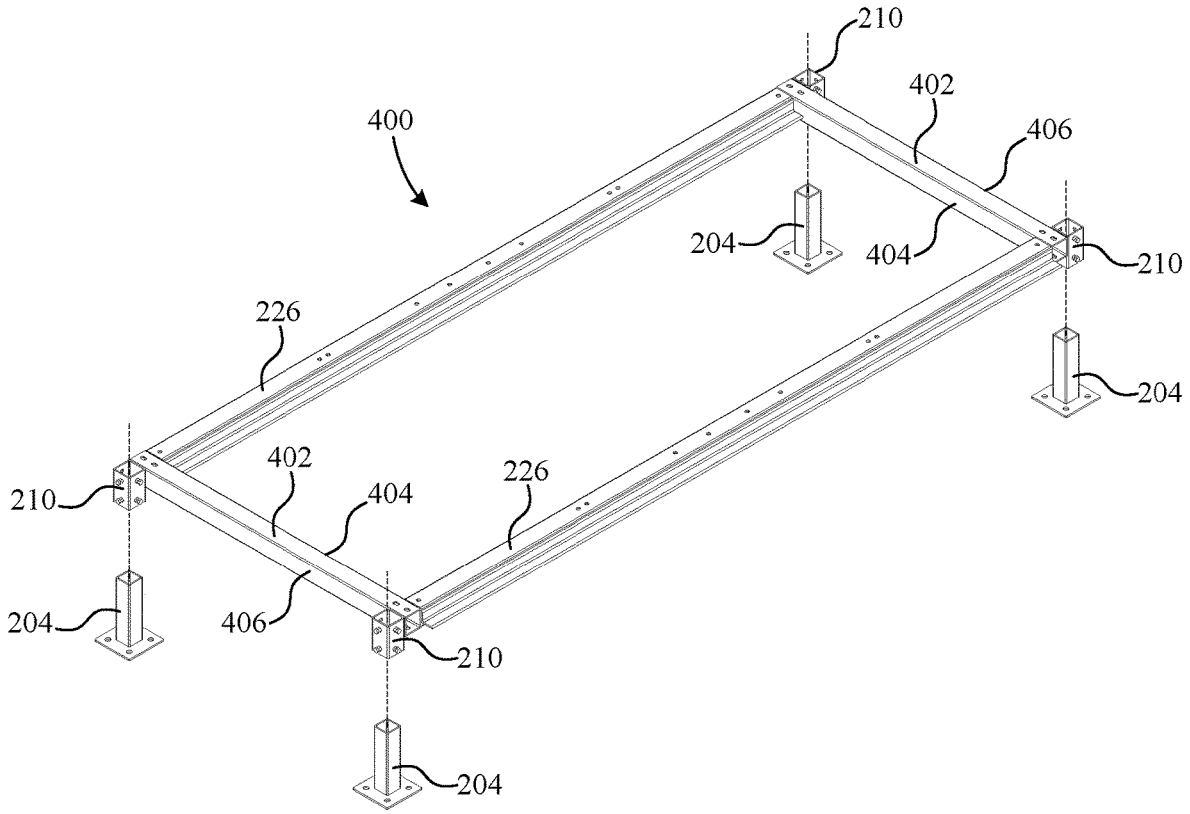
FIG. 4 is a perspective view of an intermediate structure of the frame of the platform of FIG. 1.

FIG. 4 shows a perspective view of an intermediate structure 400 of frame 202 and four of legs 204 exploded therefrom. Structure 400 includes two short beams 402 fixed between two long beams 226 to, together, form a rigid rectangular structure. In example workout station 100, beams 402 and 226 are welded together, but beams 402 and 226 can alternatively be fastened together with brackets, bolted directly to one another, or connected in any other way to facilitate disassembly. Each of beams 402 includes an inside planar sidewall 404 and an opposite outside planar sidewall 406. The first ends of beams 226 are fixed to inside planar sidewall 404 of a first one of beams 402, and the opposite, second ends of beams 226 are fixed (e.g. welded) to the inside planar sidewall 404 of the second one of beams 402. Each outside planar sidewall 406 of respective beams 402 is fixed to a respective two of receivers 210 by, for example, welding.

Figure 5:
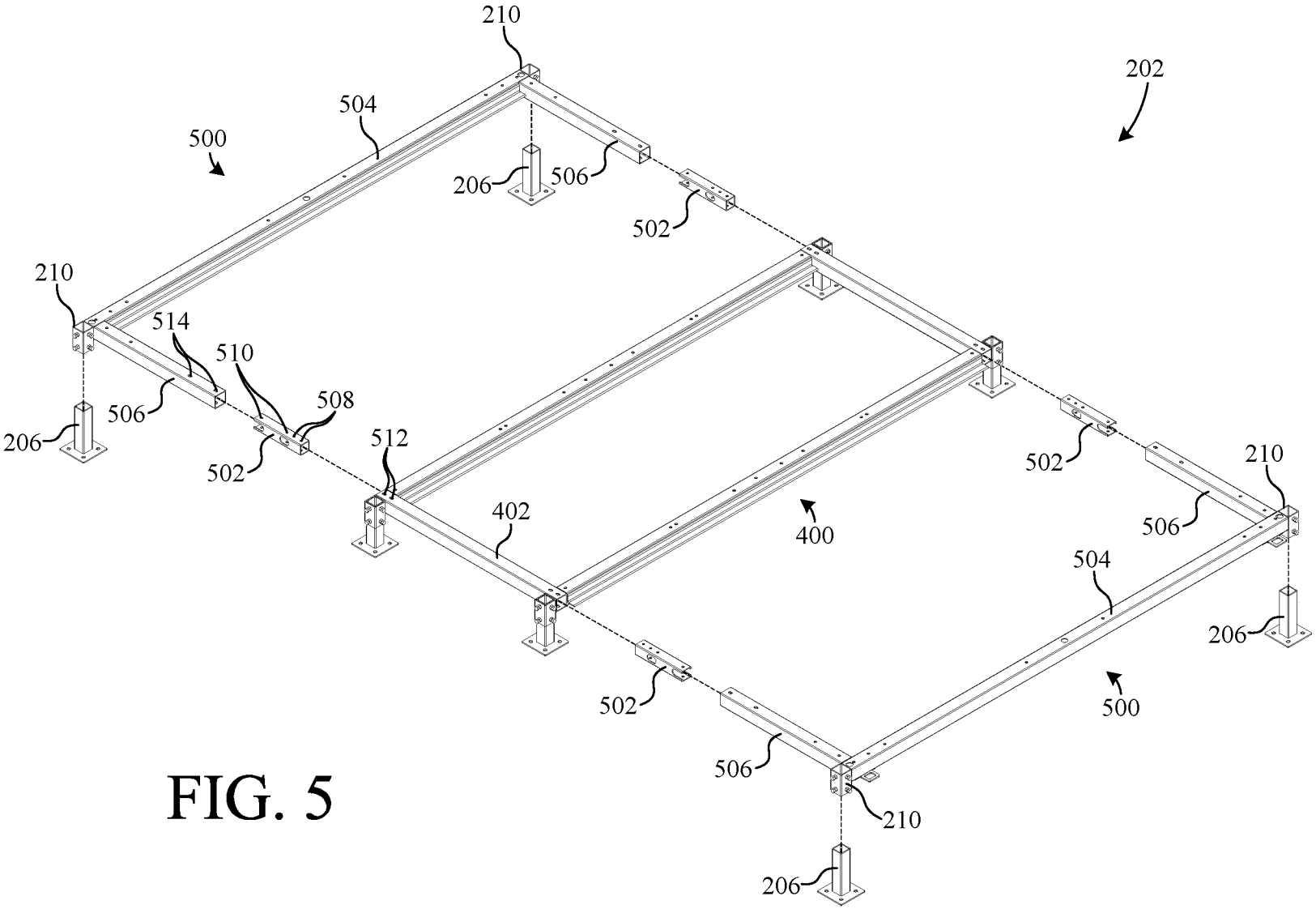
FIG. 5 is an exploded perspective view of the frame of the platform of FIG. 1.

FIG. 5 shows a perspective view of two side structures 500 and four couplers 502 of frame 202 exploded from intermediate structure 400. Each of structures 500 includes a long beam 504 interposed between two short beams 506, wherein short beams 506 are perpendicular to beam 504. Beams 506 are fixed to beam 504 by, for example, welding. Further, each of beams 506 is coaxially aligned with a respective beam 402 and a respective couplers 502. Each side structure 500 further includes a set of two receivers 210 attached thereto by, for example, welding.

Coupler 502 facilitates the mounting of beams 506 to beams 402. The outer diameter of each coupler 502 is slightly less than the inner diameter of beams 402 and 506, such that a single coupler 502 can be simultaneously inserted into both beams 402 and 506. Coupler 502 defines a first set of holes 508 and second set of holes 510. Holes 508 are spaced to align with a respective two slots 512 of beam 402 and holes 510 are spaced to align with a respective two slots 514 of beam 506. The coupling of coupler 502 to beam 402 includes partially inserting coupler 502 into beam 402 until holes 508 of coupler 502 align with slots 512 of beam 402. Once aligned, bolts (not shown) are disposed through both slots 512 and holes 508, then secured in place by a respective set of nuts (not shown). Likewise, the coupling of beam 506 to the opposite end of coupler 502 includes partially inserting coupler 502 into beam 506 until holes 510 of coupler 502 align with slots 514 of beam 506. Once aligned, bolts are disposed through both slots 514 and holes 510, then secured in place by respective nuts.

Figure 6:
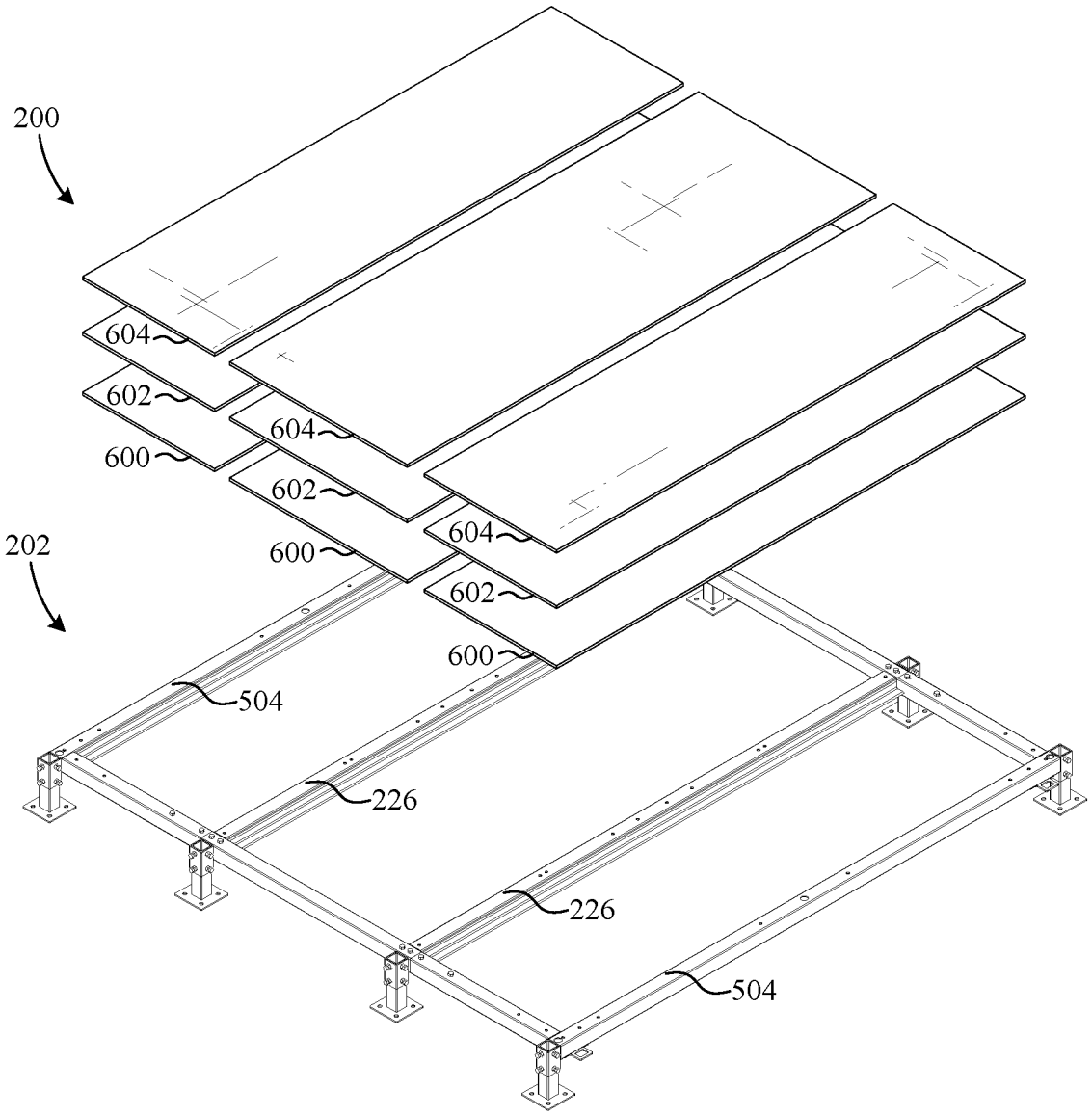
FIG. 6 is a perspective view of the platform of FIG. 1 with a plurality of floor panels exploded therefrom.

FIG. 6 shows a perspective view of floor panels 200 exploded from assembled frame 202. In the example workout station 100, panels 200 include a bottom layer of three coplanar oriented strand board (OSB) wood panels 600, a middle layer of three coplanar OSB wood panels 602, and a top layer of three coplanar rubberized panels 604, all arranged into three discrete stacks. The middle stack is configured to be seated in between beams 226 of intermediate structure 400 of frame 202. Each side stack is configured to be seated in between a respective one of beams 504 and a respective one of beams 226. Each of the three panels 600 and three panels 602 provide structural flooring support to platform 102. Panels 604 provide impact resistance for weights which might fall on top of platform 102, slip resistance for persons standing on platform 102, and so on. Panels 200 are supported by lipped features that will be described with reference to FIGS. 9-10.

Figure 7:
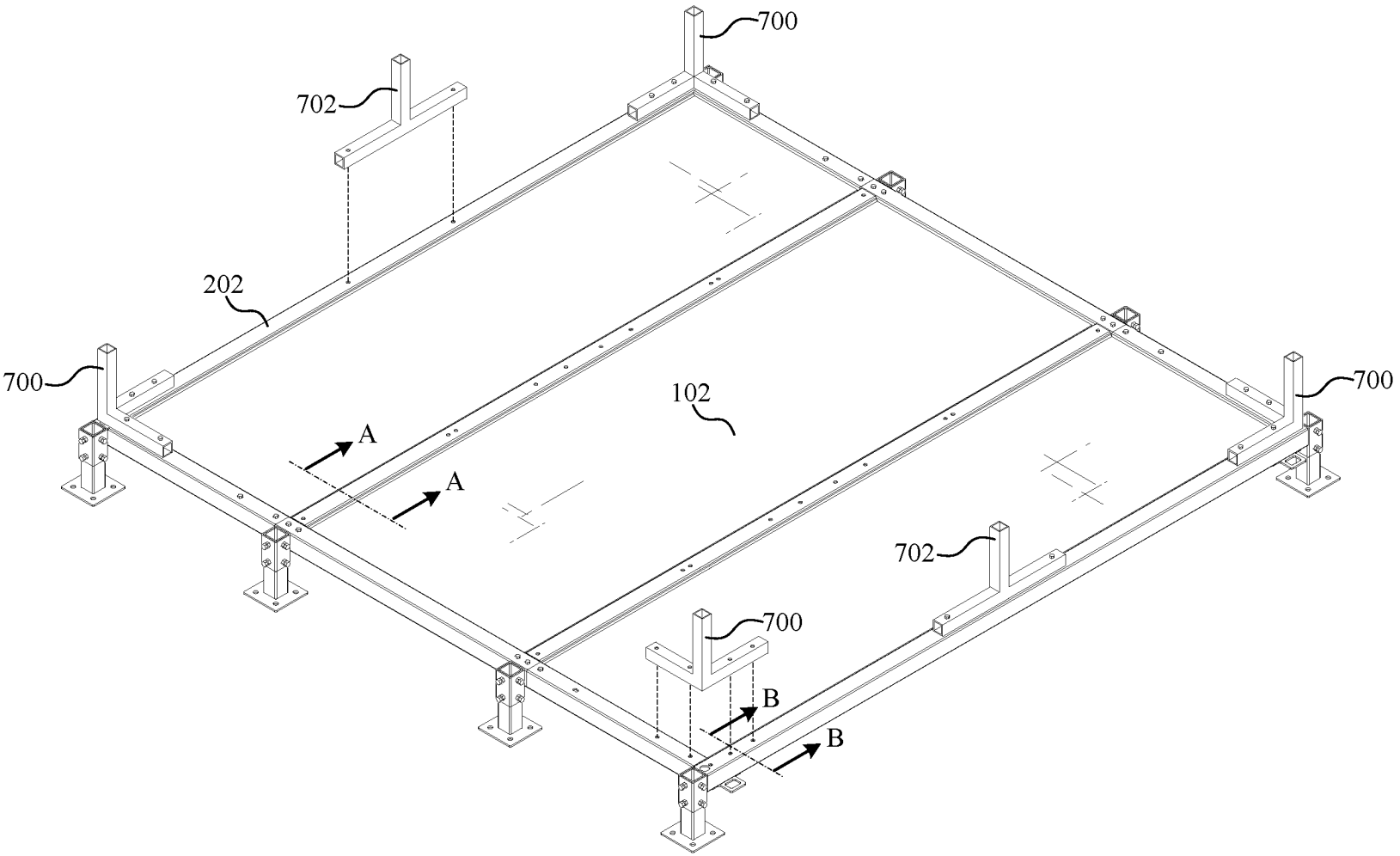
FIG. 7 is a perspective view of a plurality of brackets of the canopy assembly of FIG. 1 coupled to and exploded from the platform of FIG. 1.

FIG. 7 is a perspective view of a plurality of corner brackets 700 and center brackets 702 of frame 110 of canopy 106 mounted on frame 202 of platform 102. Brackets 700 and 702 are configured to receive the bottom ends of frame tubes 704 (shown in FIG. 8) of frame 110. Each of brackets 700 and 702 includes an open top end wherein the bottom ends of frame tubes 704 are inserted during assembly. The inner dimensions of the square stock are slightly larger than the outer diameter of frame tubes 704. Each of brackets 700 and 702 also define bolt holes that coaxially align with complementary bolt holes formed in frame 202. In this example, brackets 700 and 702 are formed from sections of square stock that are welded together.

Figure 8:
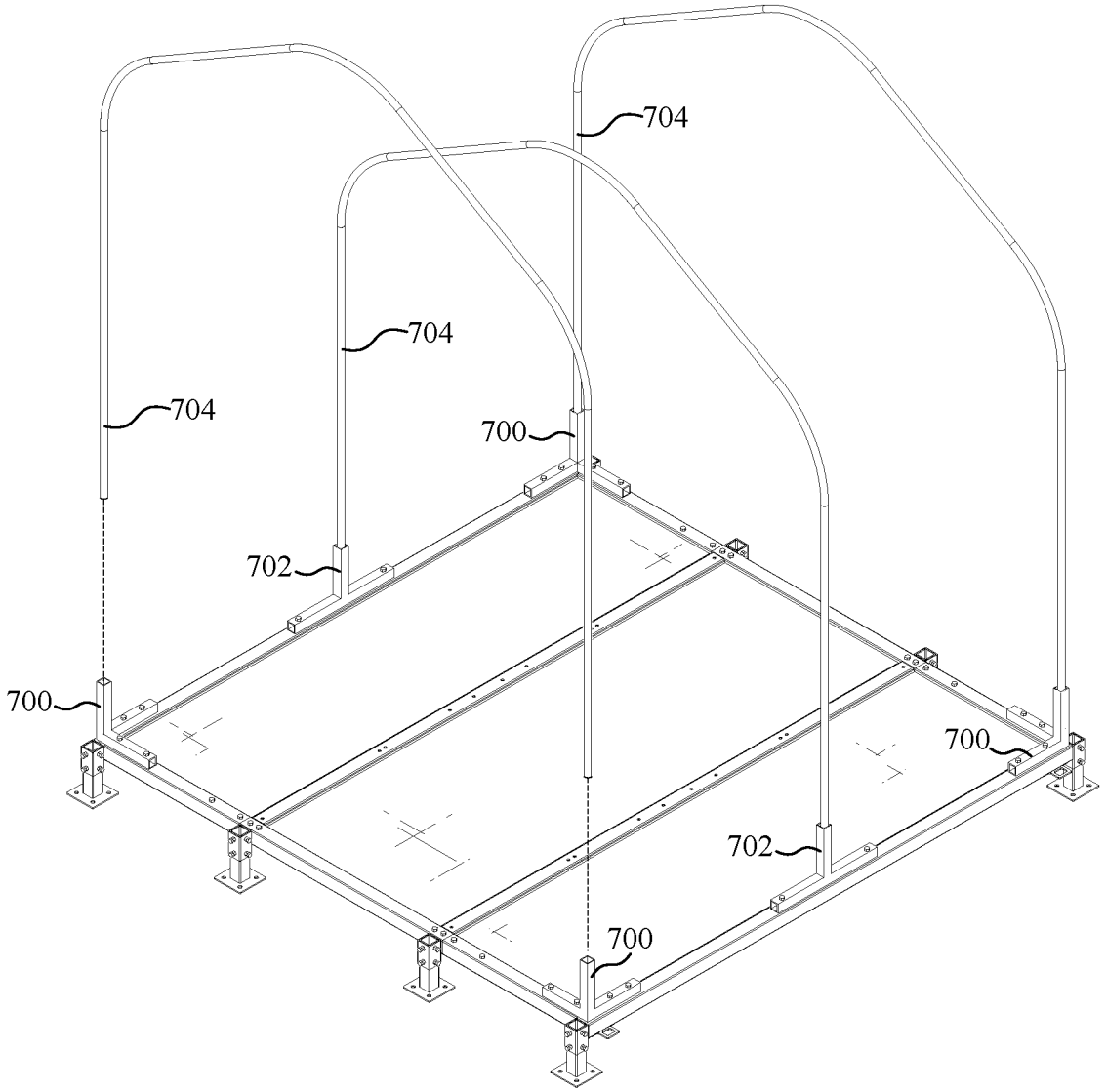
FIG. 8 is a perspective view of the platform and frame of the canopy assembly of FIG. 1.

FIG. 8 shows a perspective view of frame tubes 704 being inserted into brackets 700 and 702, with brackets 700 and 702 bolted to platform 102. As shown, each of frame tubes 704 is inserted into a respective two brackets (one end in each bracket). That is, the opposing open ends of front frame tube 704 are inserted into a respective two brackets 700, the opposing open ends of rear frame tube 704 are inserted into a respective two brackets 700, and the opposing open ends of the middle frame 704 are inserted into respective brackets 702. The ends of frame tubes 704 are removably secured in brackets 700, 702 by fasteners (not shown) of any suitable type (e.g., pins, detens, set screws, nuts and bolts, and so on).

Figure 9:
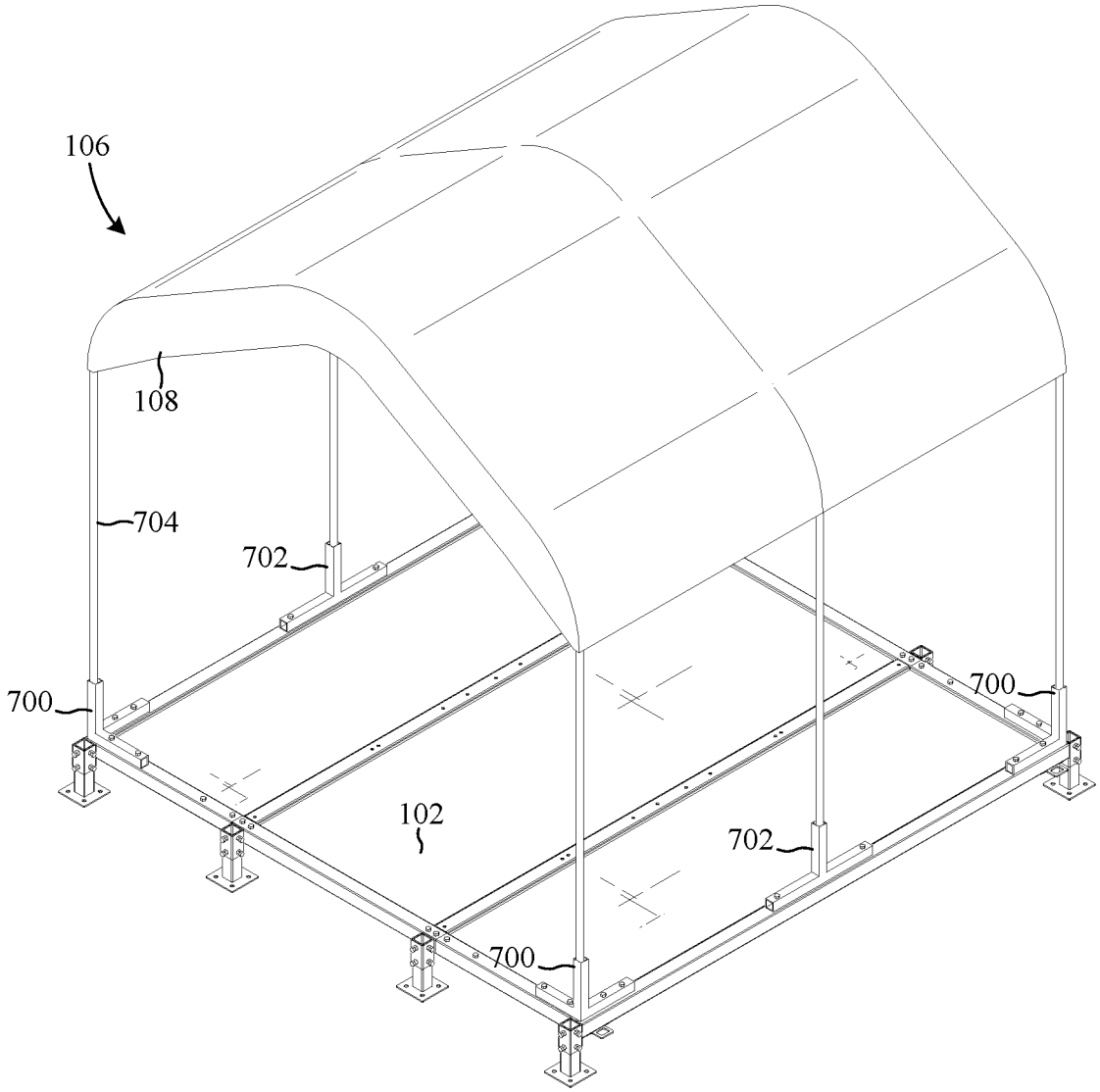
FIG. 9 is a perspective view of the platform and canopy assembly of FIG. 1.

FIG. 9 shows a perspective view of platform 102 and canopy assembly 106 wherein cover 108 is disposed over, and supported by, frame tubes 704. Cover 108 may be fixed to frame tubes 704 by any suitable fastening means such as, for example, rope, straps, cables, etc.

The assembly of platform 102 and canopy assembly 106 will now be described with reference to FIGS. 4-9.

Initially, intermediate structure 400 of frame 202 is assembled by positioning one of columns 206 into each of the four receivers 210 attached to intermediate structure 400, as illustrated in FIG. 4. Intermediate structure 400 is then leveled on the underlying supporting surface by adjusting the vertical positions of the four legs 204 as described with reference to FIG. 2. Once intermediate structure 400 is level, the legs 204 are fixed in position with respect to intermediate structure 400.

With intermediate structure 400 assembled and leveled, both side structures 500 are added to the assembly and leveled as illustrated in FIG. 5. Initially, four couplers 502 are coupled to intermediate structure 400. Specifically, each of the four couplers 502 are inserted into a respective open end of the two beams 402 of intermediate structure 400, until all holes 508 are aligned with respective slots 512. Once aligned, a bolt is inserted through each of slots 512 and, therefore, through each of complementary holes 508. Each bolt is then secured in place with a complementary nut. Optionally, the nuts may be left slightly loose so that the position of couplers 502 with respect to intermediate structure 400 can be adjusted slightly if needed. With couplers 502 extending from each open end of beams 402, each coupler 502 is inserted into a respective open end of a respective one of beams 506 until slots 514 of beams 506 are aligned with holes 510 of couplers 502. Once aligned, a bolt is inserted through each of slots 514 and, therefore, through complementary holes 510, and then secured in place with complementary nuts. Optionally, the nuts may be left slightly loose so that the position of side structures 500 with respect to intermediate structure 400 can be adjusted slightly if needed. The height of legs 204 of side structures 500 are then adjusted until side structures 500 are level with intermediate structure 400. Once leveled, the nuts and bolts passing through couplers 502 are all tightened, resulting in a rigid, level frame 202.

With frame 202 assembled and leveled, panels 200 are positioned therein as illustrated in FIG. 6. That is, panels 600 are positioned on frame 202, panels 602 are positioned on panels 600, and panels 604 are positioned on panels 602.

With platform 102 assembled, as illustrated in FIG. 7, brackets 700 and 702 are then bolted to frame 202. Note that exercise structure 104 may be loaded onto platform 102 after platform 102 is assembled and leveled. The loading of exercise structure 104 onto platform 102 may be carried out before or after canopy assembly 106 is assembled onto platform 102. Optionally, canopy assembly 106 may be omitted such that exercise structure 104 may be used on platform 102 without being shielded from the elements (i.e. rain, sunlight).

With brackets 700 and 702 bolted to frame 202, frame tubes 704 are then mounted to brackets 700 and 702, as illustrated in FIG. 8. That is, the open ends of frame tubes 704 are inserted into the upward facing open ends of brackets 700 and 702. The ends of frame tubes 704 are then secured in brackets 700 and 702 with fasteners (not shown). With frame 110 of canopy 106 assembled onto platform 102, cover 108 is positioned over frame 110 and then secured thereto as illustrated in FIG. 9.

Figure 10:
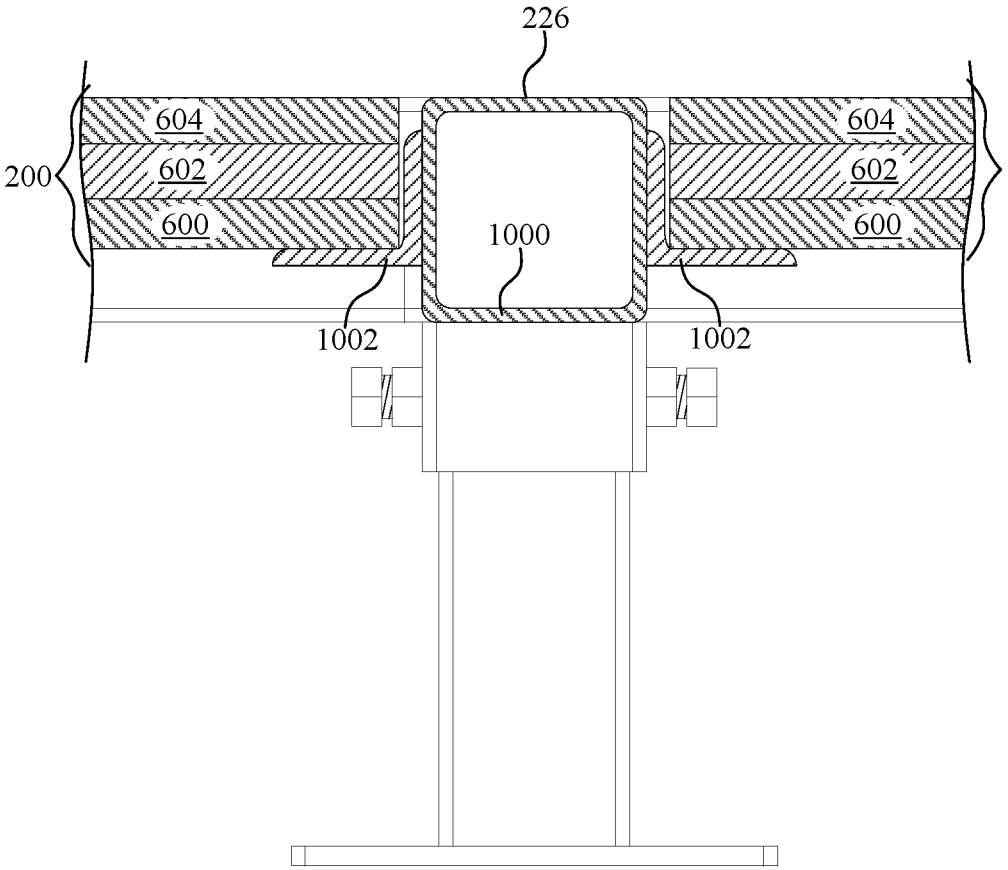
FIG. 10 is a cross-sectional plan view of the platform of FIG. 1 taken along line A-A of FIG. 7.

FIG. 10 is a cross-sectional view of platform 102 taken along line A-A of FIG. 7. As shown, beam 226 includes a section of square stock 1000 interposed between two sections of angle bar 1002. Specifically, each section of angle bar 1002 is welded (or otherwise fixed) to a respective opposing outer sidewall of square stock 1000 to form a horizontal lip that supports panels 200. The total thickness of panels 200 is such that the top planar surfaces of the stacks of panels 604 are flush to the top planar surfaces of beam 226.

Figure 11:
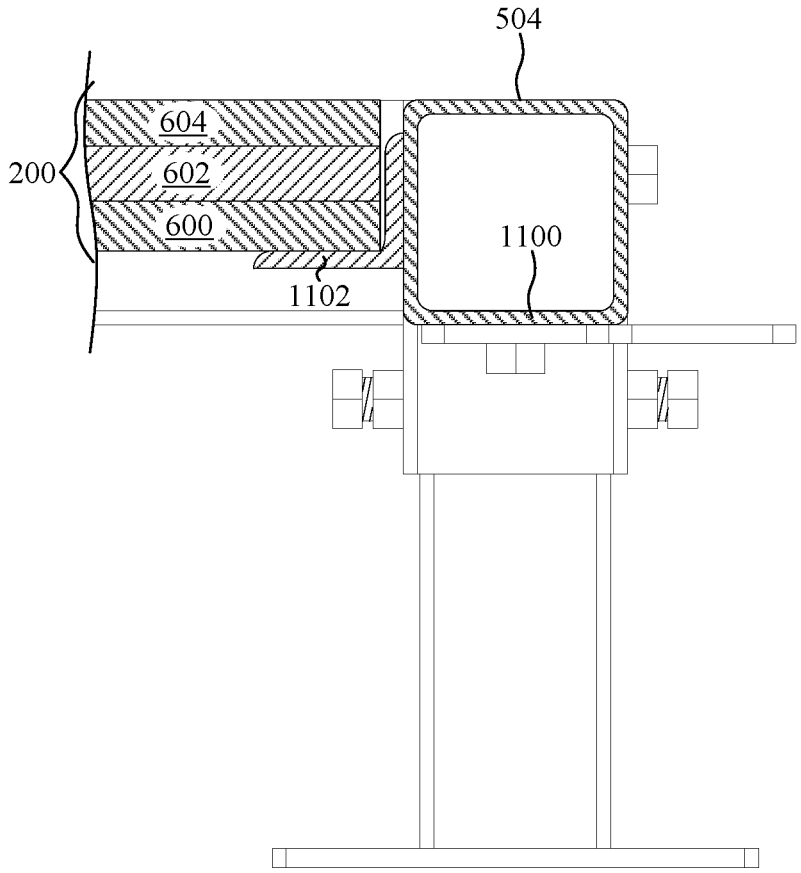
FIG. 11 shows a cross-sectional plan view of the platform of FIG. 1 taken along line B-B of FIG. 7.

FIG. 11 is a cross-sectional view of platform 102 taken along line B-B of FIG. 7. Beam 504 includes a section of square stock 1100 and a section of angle bar 1102. Angle bar 1102 is welded (or otherwise fixed) to the planar sidewall of square stock 1100 to form a horizontal lip that supports panels 200.

Figure 12:
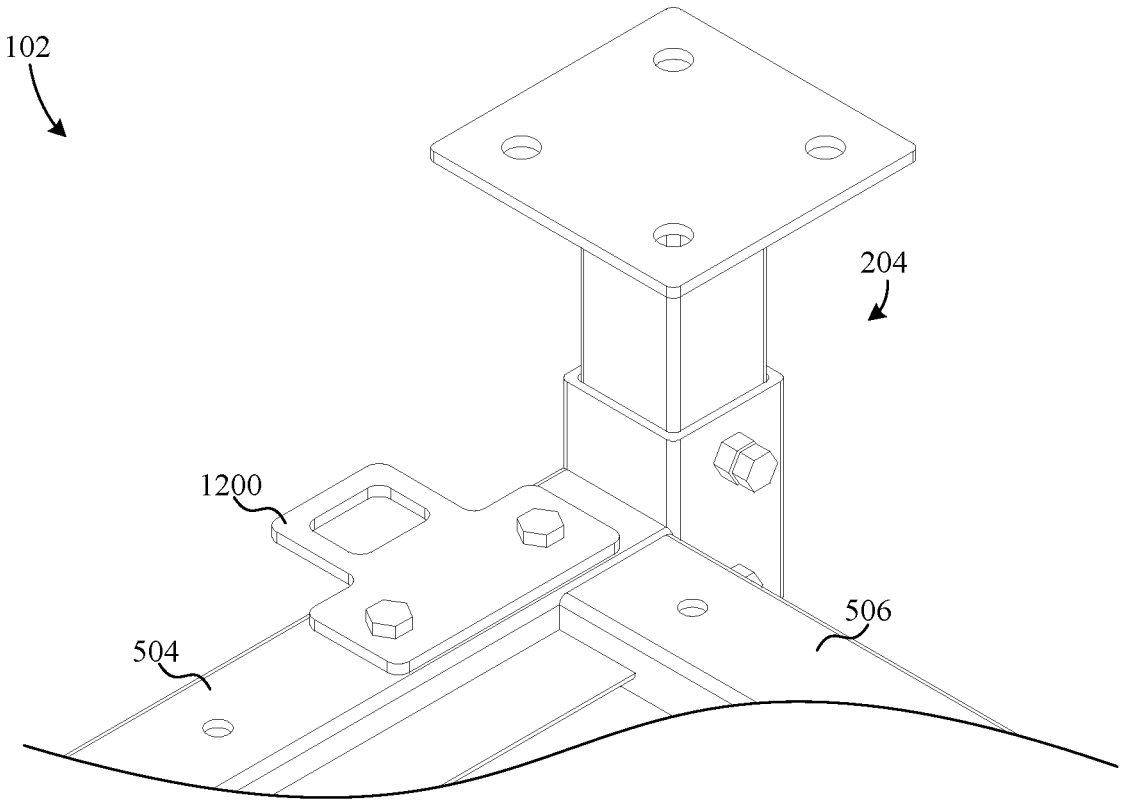
FIG. 12 shows a bottom perspective view of a corner of the platform of FIG. 1.

FIG. 12 shows a bottom perspective view of one of the four corners of platform 102. Each corner of platform 102 includes an attachment plate 1200 (only one shown in FIG. 12) bolted to the planar bottom surface of beams 504. Accordingly, platform 102 includes two attachment plates 1200 extending from each side thereof. Plates 1200 are configured to facilitate the attachment of multiple platforms together, and therefore, multiple workout stations 100 in a side-by-side configuration.

The description of particular embodiments of the present invention is now complete. Many of the described features may be substituted, altered or omitted without departing from the scope of the invention. For example, alternate leveling mechanisms (e.g., scissor lifting legs, screw lifts, etc.), may be substituted for legs 204. As another example, alternate sheet material (e.g., screen material, opaque plastic sheet material, etc.) may be substituted for cover 108. As yet another option, each bottom foot of the exercise structure can be oriented perpendicular to the support beams of the platform and be extended to be supported by at least two support beams of the platform. These and other deviations from the particular embodiments shown will be apparent to those skilled in the art, particularly in view of the foregoing disclosure.

We claim:

1. A workout station comprising:

an exercise structure;

a platform configured to support said exercise structure thereon; and a canopy assembly including a frame coupled to said platform and a cover supported over said platform by said frame; and wherein said platform includes a frame, a plurality of legs coupled to said frame of said platform, each of said legs including a bottom portion and an opposite top portion, each said bottom portion being configured to rest on an underlying supporting surface, and each said top portion being adjustably coupled to said frame of said platform to facilitate the leveling of said platform by raising and lowering each said leg with respect to said platform;

said frame of said platform includes a first beam extending along a first direction and a second beam extending along a second direction parallel to said first direction;

said exercise structure includes a first bottom portion configured to support at least a portion of the weight of said exercise structure;

said first bottom portion is disposed over said first beam;

said exercise structure includes a second bottom portion configured to support at least a portion of the weight of said exercise structure;

said second bottom portion is disposed over said second beam;

said first bottom portion of said exercise structure is fixed to said first beam;

said second bottom portion of said exercise structure is fixed to said second beam;

said exercise structure includes a first beam extending along a third direction that is parallel to said first direction;

said first beam of said exercise structure forms said first bottom portion of said exercise structure and is disposed over said first beam of said frame of said platform;

said exercise structure includes a first column extending upward from said first beam of said exercise structure;

said exercise structure includes a second beam extending along a fourth direction that is parallel to said second direction;

said second beam of said exercise structure forms said second bottom portion of said exercise structure and is disposed over said second beam of said frame of said platform; and said exercise structure includes a second column extending upward from said second beam of said exercise structure.

2. The workout station of claim 1, wherein:

said frame of said platform includes a third beam extending along a fifth direction that is perpendicular to said first direction, said third beam of said frame of said platform including a first end and an opposite second end;

said frame of said platform includes a fourth beam extending along a sixth direction that is parallel to said fifth direction, said fourth beam of said frame of said platform including a first end and an opposite second end;

said first beam of said frame of said platform includes a first end and an opposite second end;

said second beam of said frame of said platform includes a first end and an opposite second end;

said first end of said first beam of said frame of said platform is coupled to said first end of said third beam of said frame of said platform;

said second end of said first beam of said frame of said platform is coupled to said first end of said fourth beam of said frame of said platform;

said first end of said second beam of said frame of said platform is coupled to said second end of said third beam of said frame of said platform; and said second end of said second beam of said frame of said platform is coupled to said second end of said fourth beam of said frame of said platform.

3. The workout station of claim 2, wherein:

said plurality of legs includes a first leg disposed proximate said first end of said first beam of said frame of said platform and proximate said first end of said third beam of said frame of said platform;

said plurality of legs includes a second leg disposed proximate said second end of said first beam of said frame of said platform and proximate said first end of said fourth beam of said frame of said platform;

said plurality of legs includes a third leg disposed proximate said first end of said second beam of said frame of said platform and proximate said second end of said third beam of said frame of said platform; and said plurality of legs includes a fourth leg disposed proximate said second end of said second beam of said frame of said platform and proximate said second end of said fourth beam of said frame of said platform.

4. The workout station of claim 3, further comprising a first panel supported by and between said first beam of said frame of said platform, said second beam of said frame of said platform, said third beam of said frame of said platform, and said fourth beam of said frame of said platform.

5. The workout station of claim 2, wherein:

said frame of said platform further includes a fifth beam extending along a direction that is parallel to said first direction;

said fifth beam includes a first end and an opposite second end;

said frame of said platform further includes a sixth beam extending along said fifth direction;

said sixth beam includes a first end and an opposite second end;

said frame of said platform further includes a seventh beam extending along said sixth direction;

said seventh beam includes a first end and an opposite second end;

said frame of said platform further includes an eighth beam extending along a direction that is parallel to said first direction;

said eighth beam includes a first end and an opposite second end;

said frame of said platform further includes a ninth beam extending along said fifth direction;

said ninth beam includes a first end and an opposite second end;

said frame of said platform further includes a tenth beam extending along said sixth direction;

said tenth beam includes a first end and an opposite second end;

said first end of said fifth beam of said frame of said platform is coupled to said second end of said sixth beam of said frame of said platform;

said second end of said fifth beam of said frame of said platform is coupled to said second end of said seventh beam of said frame of said platform;

said first end of said sixth beam is coupled to at least one of said first end of said second beam of said frame of said platform and said second end of said third beam of said frame of said platform;

said first end of said seventh beam is coupled to at least one of said second end of said second beam of said frame of said platform and said second end of said fourth beam of said frame of said platform;

said first end of said eighth beam of said frame of said platform is coupled to said first end of said ninth beam of said frame of said platform;

said second end of said eighth beam of said frame of said platform is coupled to said first end of said tenth beam of said frame of said platform;

said second end of said ninth beam is coupled to at least one of said first end of said first beam of said frame of said platform and said first end of said third beam of said frame of said platform;

said second end of said tenth beam is coupled to at least one of said second end of said first beam of said frame of said platform and said first end of said fourth beam of said frame of said platform.

6. The workout station of claim 5, wherein said plurality of legs includes a first leg disposed proximate said first end of said first beam of said frame of said platform;

said plurality of legs includes a second leg disposed proximate said second end of said first beam of said frame of said platform;

said plurality of legs includes a third leg disposed proximate said first end of said second beam of said frame of said platform;

said plurality of legs includes a fourth leg disposed proximate said second end of said second beam of said frame of said platform;

said plurality of legs includes a fifth leg disposed proximate said first end of said fifth beam of said frame of said platform;

said plurality of legs includes a sixth leg disposed proximate said second end of said fifth beam of said frame of said platform;

said plurality of legs includes a seventh leg disposed proximate said first end of said eighth beam of said frame of said platform; and said plurality of legs includes an eighth leg disposed proximate said second end of said eighth beam of said frame of said platform.

7. The workout station of claim 6, further comprising a first floor panel, a second floor panel, and a third floor panel, and wherein:

said first floor panel is supported by and between said first beam, said second beam, said third beam, and said fourth beam of said frame of said platform;

said second floor panel is supported by and between said second beam, said fifth beam, said sixth beam, and said seventh beam of said frame of said platform; and said third floor panel is supported by and between said first beam, said eighth beam, said ninth beam, and said tenth beam of said frame of said platform.

8. The workout station of claim 5, further comprising a first floor panel, a second floor panel, and a third floor panel, and wherein:

said first floor panel is supported by and between said first beam, said second beam, said third beam, and said fourth beam of said frame of said platform;

said second floor panel is supported by and between said second beam, said fifth beam, said sixth beam, and said seventh beam of said frame of said platform; and said third floor panel is supported by and between said first beam, said eighth beam, said ninth beam, and said tenth beam of said frame of said platform.

9. The workout station of claim 8, further comprising:

a fourth floor panel supported on said first floor panel;

a fifth floor panel supported on said second floor panel; and a sixth floor panel supported on said third floor panel.

10. The workout station of claim 8, further comprising a second panel supported on said first panel.

11. The workout station of claim 1, wherein:

said frame of said platform is supported by said plurality of legs;

said exercise structure is supported by said platform; and said frame of said canopy is supported by said platform.

12. The workout station of claim 1, wherein:

said exercise structure defines a footprint on said platform;

said footprint including a first portion disposed over said first support beam; and said footprint includes a second portion disposed over said second support beam.

13. The workout station of claim 12, wherein:

said first portion of said footprint has a center;

said center of said first portion of said footprint is disposed over said first support beam;

said second portion of said footprint has a center;

said center of said second portion of said footprint is disposed over said second beam.

14. The workout station of claim 13, wherein:

said exercise structure is a weight rack having a first side frame, a second side frame, and one or more transverse members coupling said first side frame to said second side frame;

said first side frame has an elongated bottom member extending along said first direction and defining said first portion of said footprint;

said second side frame has an elongated bottom member extending along said second direction and defining said second portion of said footprint.

15. The workout station of claim 14, wherein:

said first support beam is substantially parallel to said second support beam;

said first support beam defines a first plurality of attachment apertures;

said second support beam defines a second plurality of attachment apertures;

said elongated bottom member of said first side frame is substantially parallel to said elongated bottom member of said second side frame;

said elongated bottom member of said first side frame defines a third plurality of attachment apertures; and said elongated bottom member of said second side frame defines a fourth plurality of attachment apertures; and wherein said first plurality of attachment apertures includes a greater number of attachment apertures than said third plurality of attachment apertures;

said second plurality of attachment apertures includes a greater number of apertures than said fourth plurality of attachment apertures;

said apertures of said third plurality of attachment apertures are arranged to align with different subsets of attachment apertures of said first plurality of attachment apertures; and said apertures of said fourth plurality of attachment apertures are arranged to align with different subsets of attachment apertures of said second set of attachment apertures; and whereby a position of said weight rack on said platform can be adjusted by selectively aligning said third plurality of attachment apertures with a particular one of said subsets of attachment apertures of said first set of attachment apertures, and selectively aligning said fourth plurality of attachment apertures with a particular one of said subsets of attachment apertures of said second set of attachment apertures.

16. A workout station comprising:

an exercise structure;

a platform configured to support said exercise structure thereon; and a canopy assembly including a frame coupled to said platform and a cover supported over said platform by said frame; and wherein said platform includes a frame, and a plurality of legs coupled to said frame of said platform, each of said legs including a bottom portion and an opposite top portion, each said bottom portion being configured to rest on an underlying supporting surface, and each said top portion being adjustably coupled to said frame of said platform to facilitate the leveling of said platform by raising and lowering each said leg with respect to said platform; and wherein said frame of said platform includes a first beam extending along a first direction and a second beam extending along a second direction parallel to said first direction;

said frame of said platform includes a third beam extending along a third direction that is perpendicular to said first direction, said third beam of said frame of said platform including a first end and an opposite second end;

said frame of said platform includes a fourth beam extending along a fourth direction that is parallel to said third direction, said fourth beam of said frame of said platform including a first end and an opposite second end;

said first beam of said frame of said platform includes a first end and an opposite second end;

said second beam of said frame of said platform includes a first end and an opposite second end;

said first end of said first beam of said frame of said platform is coupled to said first end of said third beam of said frame of said platform;

said second end of said first beam of said frame of said platform is coupled to said first end of said fourth beam of said frame of said platform;

said first end of said second beam of said frame of said platform is coupled to said second end of said third beam of said frame of said platform; and said second end of said second beam of said frame of said platform is coupled to said second end of said fourth beam of said frame of said platform.

17. The workout station of claim 16, wherein:

said exercise structure includes a first bottom portion configured to support at least a portion of the weight of said exercise structure;

said first bottom portion is disposed over said first beam;

said exercise structure includes a second bottom portion configured to support at least a portion of the weight of said exercise structure; and said second bottom portion is disposed over said second beam.

18. The workout station of claim 17, wherein:

said first bottom portion of said exercise structure is fixed to said first beam; and said second bottom portion of said exercise structure is fixed to said second beam.

19. The workout station of claim 16, wherein:

said plurality of legs includes a first leg disposed proximate said first end of said first beam of said frame of said platform and proximate said first end of said third beam of said frame of said platform;

said plurality of legs includes a second leg disposed proximate said second end of said first beam of said frame of said platform and proximate said first end of said fourth beam of said frame of said platform;

said plurality of legs includes a third leg disposed proximate said first end of said second beam of said frame of said platform and proximate said second end of said third beam of said frame of said platform; and said plurality of legs includes a fourth leg disposed proximate said second end of said second beam of said frame of said platform and proximate said second end of said fourth beam of said frame of said platform.

20. The workout station of claim 19, further comprising a first panel supported by and between said first beam of said frame of said platform, said second beam of said frame of said platform, said third beam of said frame of said platform, and said fourth beam of said frame of said platform.

21. The workout station of claim 16, wherein:

said frame of said platform further includes a fifth beam extending along a direction that is parallel to said first direction;

said fifth beam includes a first end and an opposite second end;

said frame of said platform further includes a sixth beam extending along said third direction;

said sixth beam includes a first end and an opposite second end;

said frame of said platform further includes a seventh beam extending along said fourth direction;

said seventh beam includes a first end and an opposite second end;

said frame of said platform further includes an eighth beam extending along a direction that is parallel to said first direction;

said eighth beam includes a first end and an opposite second end;

said frame of said platform further includes a ninth beam extending along said third direction;

said ninth beam includes a first end and an opposite second end;

said frame of said platform further includes a tenth beam extending along said fourth direction;

said tenth beam includes a first end and an opposite second end;

said first end of said fifth beam of said frame of said platform is coupled to said second end of said sixth beam of said frame of said platform;

said second end of said fifth beam of said frame of said platform is coupled to said second end of said seventh beam of said frame of said platform;

said first end of said sixth beam is coupled to at least one of said first end of said second beam of said frame of said platform and said second end of said third beam of said frame of said platform;

said first end of said seventh beam is coupled to at least one of said second end of said second beam of said frame of said platform and said second end of said fourth beam of said frame of said platform;

said first end of said eighth beam of said frame of said platform is coupled to said first end of said ninth beam of said frame of said platform;

said second end of said eighth beam of said frame of said platform is coupled to said first end of said tenth beam of said frame of said platform;

said second end of said ninth beam is coupled to at least one of said first end of said first beam of said frame of said platform and said first end of said third beam of said frame of said platform;

said second end of said tenth beam is coupled to at least one of said second end of said first beam of said frame of said platform and said first end of said fourth beam of said frame of said platform.

22. The workout station of claim 21, wherein said plurality of legs includes a first leg disposed proximate said first end of said first beam of said frame of said platform;

said plurality of legs includes a second leg disposed proximate said second end of said first beam of said frame of said platform;

said plurality of legs includes a third leg disposed proximate said first end of said second beam of said frame of said platform;

said plurality of legs includes a fourth leg disposed proximate said second end of said second beam of said frame of said platform;

said plurality of legs includes a fifth leg disposed proximate said first end of said fifth beam of said frame of said platform;

said plurality of legs includes a sixth leg disposed proximate said second end of said fifth beam of said frame of said platform;

said plurality of legs includes a seventh leg disposed proximate said first end of said eighth beam of said frame of said platform; and said plurality of legs includes an eighth leg disposed proximate said second end of said eighth beam of said frame of said platform.

23. The workout station of claim 22, further comprising a first floor panel, a second floor panel, and a third floor panel, and wherein:

said first floor panel is supported by and between said first beam, said second beam, said third beam, and said fourth beam of said frame of said platform;

said second floor panel is supported by and between said second beam, said fifth beam, said sixth beam, and said seventh beam of said frame of said platform; and said third floor panel is supported by and between said first beam, said eighth beam, said ninth beam, and said tenth beam of said frame of said platform.

24. The workout station of claim 21, further comprising a first floor panel, a second floor panel, and a third floor panel, and wherein:

said first floor panel is supported by and between said first beam, said second beam, said third beam, and said fourth beam of said frame of said platform;

said second floor panel is supported by and between said second beam, said fifth beam, said sixth beam, and said seventh beam of said frame of said platform; and said third floor panel is supported by and between said first beam, said eighth beam, said ninth beam, and said tenth beam of said frame of said platform.

25. The workout station of claim 24, further comprising:

a fourth floor panel supported on said first floor panel;

a fifth floor panel supported on said second floor panel; and a sixth floor panel supported on said third floor panel.

26. The workout station of claim 24, further comprising a second panel supported on said first panel.

27. The workout station of claim 16, wherein:

said frame of said platform is supported by said plurality of legs;

said exercise structure is supported by said platform; and said frame of said canopy is supported by said platform.

28. The workout station of claim 16, wherein:

said platform includes a first support beam and a second support beam;

said exercise structure defines a footprint on said platform;

said footprint including a first portion disposed over said first support beam; and said footprint includes a second portion disposed over said second support beam.

29. The workout station of claim 28, wherein:

said first portion of said footprint has a center;

said center of said first portion of said footprint is disposed over said first support beam;

said second portion of said footprint has a center;

said center of said second portion of said footprint is disposed over said second beam.

30. The workout station of claim 29, wherein:

said exercise structure is a weight rack having a first side frame, a second side frame, and one or more transverse members coupling said first side frame to said second side frame;

said first support beam extends along a first direction;

said second support beam extends along a second direction;

said first side frame has an elongated bottom member extending along said first direction and defining said first portion of said footprint;

said second side frame has an elongated bottom member extending along said second direction and defining said second portion of said footprint.

31. The workout station of claim 30, wherein:

said first support beam is substantially parallel to said second support beam;

said first support beam defines a first plurality of attachment apertures;

said second support beam defines a second plurality of attachment apertures;

said elongated bottom member of said first side frame is substantially parallel to said elongated bottom member of said second side frame;

said elongated bottom member of said first side frame defines a third plurality of attachment apertures; and said elongated bottom member of said second side frame defines a fourth plurality of attachment apertures; and wherein said first plurality of attachment apertures includes a greater number of attachment apertures than said third plurality of attachment apertures;

said second plurality of attachment apertures includes a greater number of apertures than said fourth plurality of attachment apertures;

said apertures of said third plurality of attachment apertures are arranged to align with different subsets of attachment apertures of said first plurality of attachment apertures; and said apertures of said fourth plurality of attachment apertures are arranged to align with different subsets of attachment apertures of said second set of attachment apertures; and whereby a position of said weight rack on said platform can be adjusted by selectively aligning said third plurality of attachment apertures with a particular one of said subsets of attachment apertures of said first set of attachment apertures, and selectively aligning said fourth plurality of attachment apertures with a particular one of said subsets of attachment apertures of said second set of attachment apertures.

32. A workout station comprising:

an exercise structure;

a platform configured to support said exercise structure thereon; and a canopy assembly including a frame coupled to said platform and a cover supported over said platform by said frame; and wherein said platform includes a frame, and a plurality of legs coupled to said frame of said platform, each of said legs including a bottom portion and an opposite top portion, each said bottom portion being configured to rest on an underlying supporting surface, and each said top portion being adjustably coupled to said frame of said platform to facilitate the leveling of said platform by raising and lowering each said leg with respect to said platform; and wherein said platform includes a first support beam and a second support beam;

said exercise structure defines a footprint on said platform;

said footprint including a first portion disposed over said first support beam;

said footprint includes a second portion disposed over said second support beam;

said first portion of said footprint has a center;

said center of said first portion of said footprint is disposed over said first support beam;

said second portion of said footprint has a center;

said center of said second portion of said footprint is disposed over said second beam;

said exercise structure is a weight rack having a first side frame, a second side frame, and one or more transverse members coupling said first side frame to said second side frame;

said first support beam extends along a first direction;

said second support beam extends along a second direction;

said first side frame has an elongated bottom member extending along said first direction and defining said first portion of said footprint; and said second side frame has an elongated bottom member extending along said second direction and defining said second portion of said footprint.

33. The workout station of claim 32, wherein said first beam of said platform extends along a first direction and said second beam of said platform extends along a second direction parallel to said first direction.

34. The workout station of claim 33, wherein:

said exercise structure includes a first bottom portion configured to support at least a portion of the weight of said exercise structure;

said first bottom portion is disposed over said first beam;

said exercise structure includes a second bottom portion configured to support at least a portion of the weight of said exercise structure; and said second bottom portion is disposed over said second beam.

35. The workout station of claim 34, wherein:

said first bottom portion of said exercise structure is fixed to said first beam; and said second bottom portion of said exercise structure is fixed to said second beam.

36. The workout station of claim 33, wherein:

said frame of said platform includes a third beam extending along a third direction that is perpendicular to said first direction, said third beam of said frame of said platform including a first end and an opposite second end;

said frame of said platform includes a fourth beam extending along a fourth direction that is parallel to said third direction, said fourth beam of said frame of said platform including a first end and an opposite second end;

said first beam of said frame of said platform includes a first end and an opposite second end;

said second beam of said frame of said platform includes a first end and an opposite second end;

said first end of said first beam of said frame of said platform is coupled to said first end of said third beam of said frame of said platform;

said second end of said first beam of said frame of said platform is coupled to said first end of said fourth beam of said frame of said platform;

said first end of said second beam of said frame of said platform is coupled to said second end of said third beam of said frame of said platform; and said second end of said second beam of said frame of said platform is coupled to said second end of said fourth beam of said frame of said platform.

37. The workout station of claim 36, wherein:

said plurality of legs includes a first leg disposed proximate said first end of said first beam of said frame of said platform and proximate said first end of said third beam of said frame of said platform;

said plurality of legs includes a second leg disposed proximate said second end of said first beam of said frame of said platform and proximate said first end of said fourth beam of said frame of said platform;

said plurality of legs includes a third leg disposed proximate said first end of said second beam of said frame of said platform and proximate said second end of said third beam of said frame of said platform; and said plurality of legs includes a fourth leg disposed proximate said second end of said second beam of said frame of said platform and proximate said second end of said fourth beam of said frame of said platform.

38. The workout station of claim 37, further comprising a first panel supported by and between said first beam of said frame of said platform, said second beam of said frame of said platform, said third beam of said frame of said platform, and said fourth beam of said frame of said platform.

39. The workout station of claim 36, wherein:

said frame of said platform further includes a fifth beam extending along a direction that is parallel to said first direction;

said fifth beam includes a first end and an opposite second end;

said frame of said platform further includes a sixth beam extending along said third direction;

said sixth beam includes a first end and an opposite second end;

said frame of said platform further includes a seventh beam extending along said fourth direction;

said seventh beam includes a first end and an opposite second end;

said frame of said platform further includes an eighth beam extending along a direction that is parallel to said first direction;

said eighth beam includes a first end and an opposite second end;

said frame of said platform further includes a ninth beam extending along said third direction;

said ninth beam includes a first end and an opposite second end;

said frame of said platform further includes a tenth beam extending along said fourth direction;

said tenth beam includes a first end and an opposite second end;

said first end of said fifth beam of said frame of said platform is coupled to said second end of said sixth beam of said frame of said platform;

said second end of said fifth beam of said frame of said platform is coupled to said second end of said seventh beam of said frame of said platform;

said first end of said sixth beam is coupled to at least one of said first end of said second beam of said frame of said platform and said second end of said third beam of said frame of said platform;

said first end of said seventh beam is coupled to at least one of said second end of said second beam of said frame of said platform and said second end of said fourth beam of said frame of said platform;

said first end of said eighth beam of said frame of said platform is coupled to said first end of said ninth beam of said frame of said platform;

said second end of said eighth beam of said frame of said platform is coupled to said first end of said tenth beam of said frame of said platform;

said second end of said ninth beam is coupled to at least one of said first end of said first beam of said frame of said platform and said first end of said third beam of said frame of said platform;

said second end of said tenth beam is coupled to at least one of said second end of said first beam of said frame of said platform and said first end of said fourth beam of said frame of said platform.

40. The workout station of claim 39, wherein said plurality of legs includes a first leg disposed proximate said first end of said first beam of said frame of said platform;

said plurality of legs includes a second leg disposed proximate said second end of said first beam of said frame of said platform;

said plurality of legs includes a third leg disposed proximate said first end of said second beam of said frame of said platform;

said plurality of legs includes a fourth leg disposed proximate said second end of said second beam of said frame of said platform;

said plurality of legs includes a fifth leg disposed proximate said first end of said fifth beam of said frame of said platform;

said plurality of legs includes a sixth leg disposed proximate said second end of said fifth beam of said frame of said platform;

said plurality of legs includes a seventh leg disposed proximate said first end of said eighth beam of said frame of said platform; and said plurality of legs includes an eighth leg disposed proximate said second end of said eighth beam of said frame of said platform.

41. The workout station of claim 40, further comprising a first floor panel, a second floor panel, and a third floor panel, and wherein:

said first floor panel is supported by and between said first beam, said second beam, said third beam, and said fourth beam of said frame of said platform;

said second floor panel is supported by and between said second beam, said fifth beam, said sixth beam, and said seventh beam of said frame of said platform; and said third floor panel is supported by and between said first beam, said eighth beam, said ninth beam, and said tenth beam of said frame of said platform.

42. The workout station of claim 39, further comprising a first floor panel, a second floor panel, and a third floor panel, and wherein:

said first floor panel is supported by and between said first beam, said second beam, said third beam, and said fourth beam of said frame of said platform;

said second floor panel is supported by and between said second beam, said fifth beam, said sixth beam, and said seventh beam of said frame of said platform; and said third floor panel is supported by and between said first beam, said eighth beam, said ninth beam, and said tenth beam of said frame of said platform.

43. The workout station of claim 42, further comprising:

a fourth floor panel supported on said first floor panel;

a fifth floor panel supported on said second floor panel; and a sixth floor panel supported on said third floor panel.

44. The workout station of claim 42, further comprising a second panel supported on said first panel.

45. The workout station of claim 32, wherein:

said frame of said platform is supported by said plurality of legs;

said exercise structure is supported by said platform; and said frame of said canopy is supported by said platform.

46. The workout station of claim 32, wherein:

said first support beam is substantially parallel to said second support beam;

said first support beam defines a first plurality of attachment apertures;

said second support beam defines a second plurality of attachment apertures;

said elongated bottom member of said first side frame is substantially parallel to said elongated bottom member of said second side frame;

said elongated bottom member of said first side frame defines a third plurality of attachment apertures; and said elongated bottom member of said second side frame defines a fourth plurality of attachment apertures; and wherein said first plurality of attachment apertures includes a greater number of attachment apertures than said third plurality of attachment apertures;

said second plurality of attachment apertures includes a greater number of apertures than said fourth plurality of attachment apertures;

said apertures of said third plurality of attachment apertures are arranged to align with different subsets of attachment apertures of said first plurality of attachment apertures; and said apertures of said fourth plurality of attachment apertures are arranged to align with different subsets of attachment apertures of said second set of attachment apertures; and whereby a position of said weight rack on said platform can be adjusted by selectively aligning said third plurality of attachment apertures with a particular one of said subsets of attachment apertures of said first set of attachment apertures, and selectively aligning said fourth plurality of attachment apertures with a particular one of said subsets of attachment apertures of said second set of attachment apertures.

* * * * *